US006843331B2

(12) United States Patent
de Boer

(10) Patent No.: US 6,843,331 B2
(45) Date of Patent: Jan. 18, 2005

(54) METHOD AND APPARATUS FOR VARYING THE DENSITY OF DRILLING FLUIDS IN DEEP WATER OIL DRILLING APPLICATIONS

(76) Inventor: Luc de Boer, 7516 Olympia Dr., Houston, TX (US) 77063-1919

( * ) Notice: Subject to any disclaimer, the term of this patent is extended or adjusted under 35 U.S.C. 154(b) by 94 days.

(21) Appl. No.: 10/289,505

(22) Filed: Nov. 6, 2002

(65) Prior Publication Data

US 2003/0070840 A1 Apr. 17, 2003

Related U.S. Application Data

(63) Continuation-in-part of application No. 09/784,367, filed on Feb. 15, 2001, now Pat. No. 6,536,540.

(51) Int. Cl.[7] ..... C09K 7/08

(52) U.S. Cl. ..... 175/70; 175/7; 175/66; 175/71; 175/217

(58) Field of Search ..... 175/5, 7, 8, 65, 175/66, 69–71, 206, 207; 166/357, 358, 367, 368

(56) References Cited

U.S. PATENT DOCUMENTS

| | | | | |
|---|---|---|---|---|
| 3,603,409 A | | 9/1971 | Watkins | 175/7 |
| 4,040,264 A | * | 8/1977 | Neilon | 405/224.2 |
| 4,099,583 A | | 7/1978 | Maus | 175/7 |
| 4,291,772 A | | 9/1981 | Beynet | 175/5 |
| 5,873,420 A | | 2/1999 | Gearhart | 175/25 |
| 6,152,246 A | | 11/2000 | King | 175/26 |
| 6,179,071 B1 | | 1/2001 | Dietzen | 175/66 |
| 6,230,824 B1 | * | 5/2001 | Peterman et al. | 175/214 |
| 6,450,262 B1 | * | 9/2002 | Regan | 166/350 |
| 6,536,540 B2 | * | 3/2003 | de Boer | 175/70 |

OTHER PUBLICATIONS

IADC/SPE 1996 Drilling Conference Abstract Reporting Form/ 1 Page.

* cited by examiner

*Primary Examiner*—Zakiya Walker
(74) *Attorney, Agent, or Firm*—Jackson Walker L.L.P.; Mark A. Tidwell, Esq.

(57) ABSTRACT

A method and apparatus for controlling drilling mud density at a location either at the seabed (or just above the seabed) or alternatively below the seabed of wells in deep water and ultra deep water applications combines a base fluid of lesser density than the mud required at the wellhead to produce a diluted mud in the riser. By combining the appropriate quantities of drilling mud with base fluid, a riser mud density at or near the density of seawater may be achieved. A wellhead injection device for attachment to the wellhead is used for injecting the base fluid into the rising drilling mud at a location below the seabed. The riser charging lines are used to carry the low density base fluid to the injection device for injection into the drilling mud below the seabed. The cuttings are brought to the surface with the diluted mud and separated in the usual manner. The diluted mud is then passed through a centrifuge system to separate the heavier drilling mud from the lighter base fluid.

20 Claims, 8 Drawing Sheets

METHOD AND APPARATUS FOR VARYING THE DENSITY OF DRILLING FLUIDS IN DEEP WATER OIL DRILLING APPLICATIONS

CROSS-REFERENCE TO RELATED APPLICATIONS

The present application is a continuation-in-part of U.S. patent application Ser. No. 09/784,367 filed on Feb. 15, 2001, now U.S. Pat. No. 6,536,540.

BACKGROUND OF THE INVENTION

1. Field of the Invention

The subject invention is generally related to systems for delivering drilling fluid (or "drilling mud") for oil and gas drilling applications and is specifically directed to a method and apparatus for varying the density of drilling mud in deep water oil and gas drilling applications.

2. Description of the Prior Art

It is well known to use drilling mud to drive drill bits, to maintain hydrostatic pressure, and to carry away particulate matter when drilling for oil and gas in subterranean wells. Basically, the drilling mud is pumped down the drill pipe and provides the fluid driving force to operate the drill bit, and then it flows back up from the bit along the periphery of the drill pipe and inside the open hole and casing for removing the particles loosed by the drill bit. At the surface, the return mud is cleaned to remove the particles and then is recycled down into the hole.

The density of the drilling mud is monitored and controlled in order to maximize the efficiency of the drilling operation and to maintain the hydrostatic pressure. In a typical application, a well is drilled using a drill bit mounted on the end of a drill stem inserted down the drill pipe. The drilling mud is pumped down the drill pipe and through the drill bit to drive the bit. A gas flow and/or other additives are also pumped into the drill pipe to control the density of the mud. The mud passes through the drill bit and flows upwardly along the drill string inside the open hole and casing, carrying the loosed particles to the surface.

One example of such a system is shown and described in U.S. Pat. No. 5,873,420, entitled: "Air and Mud Control System for Underbalanced Drilling", issued on Feb. 23, 1999 to Marvin Gearhart. The system shown and described in the Gearhart patent provides for a gas flow in the tubing for mixing the gas with the mud in a desired ratio so that the mud density is reduced to permit enhanced drilling rates by maintaining the well in an underbalanced condition.

It is known that there is a preexistent pressure on the formations of the earth, which, in general, increases as a function of depth due to the weight of the overburden on particular strata. This weight increases with depth so the prevailing or quiescent bottom hole pressure is increased in a generally linear curve with respect to depth. As the well depth is doubled, the pressure is likewise doubled. This is further complicated when drilling in deep water or ultra deep water because of the pressure on the sea floor by the water above it. Thus, high pressure conditions exist at the beginning of the hole and increase as the well is drilled. It is important to maintain a balance between the mud density and pressure and the hole pressure. Otherwise, the pressure in the hole will force material back into the well bore and cause what is commonly known as a "blowout." In basic terms, a blow out occurs when the gases or fluids in the well bore flow out of the formation into the well bore and bubble upward. When the standing column of drilling fluid is equal to or greater than the pressure at the depth of the borehole, the conditions leading to a blowout are minimized. When the mud density is insufficient, the gases or fluids in the borehole can cause the mud to decrease in density and become so light that a blowout occurs.

Blowouts are a threat to drilling operations and a significant risk to both drilling personnel and the environment. Typically blowout preventers (or "BOP's") are installed at the ocean floor to minimize a blowout from an out-of-balance well. However, the primary method for minimizing a risk of a blowout condition is the proper balancing of the drilling mud density to maintain the well in a balanced condition at all times. While BOP's can contain a blowout and minimize the damage to personnel and the environment, the well is usually lost once a blowout occurs, even if contained. It is far more efficient and desirable to use proper mud control techniques in order to reduce the risk of a blowout than it is to contain a blowout once it occurs.

In order to maintain a safe margin, the column of drilling mud in the annular space around the drill stem is of sufficient weight and density to produce a high enough pressure to limit risk to near-zero in normal drilling conditions. While this is desirable, it unfortunately slows down the drilling process. In some cases underbalanced drilling has been attempted in order to increase the drilling rate. However, to the present day, the mud density is the main component for maintaining a pressurized well under control.

Deep water and ultra deep water drilling has its own set of problems coupled with the need to provide a high density drilling mud in a well bore that starts several thousand feet below sea level. The pressure at the beginning of the hole is equal to the hydrostatic pressure of the seawater above it, but the mud must travel from the sea surface to the sea floor before its density is useful. It is well recognized that it would be desirable to maintain mud density at or near seawater density (or 8.6 PPG) when above the borehole and at a heavier density from the seabed down into the well. In the past, pumps have been employed near the seabed for pumping out the returning mud and cuttings from the seabed above the BOP's and to the surface using a return line that is separate from the riser. This system is expensive to install, as it requires separate lines, expensive to maintain, and very expensive to run. Another experimental method employs the injection of low density particles—such—as glass beads into the returning fluid in the riser above the sea floor to reduce the density of the returning mud as it is brought to the surface. Typically, the BOP stack is on the sea floor and the glass beads are injected above the BOP stack.

While it has been proven desirable to reduce drilling mud density at a location near and below the seabed in a well bore, there are no prior art techniques that effectively accomplish this objective.

SUMMARY OF THE INVENTION

The present invention is directed at a method and apparatus for controlling drilling mud density in deep water or ultra deep water drilling applications.

It is an important aspect of the present invention that the drilling mud is diluted using a base fluid. The base fluid is of lesser density than the drilling mud required at the wellhead. The base fluid and drilling mud are combined to yield a diluted mud.

In a preferred embodiment of the present invention, the base fluid has a density less than seawater (or less than 8.6 PPG). By combining the appropriate quantities of drilling mud with base fluid, a riser mud density at or near the density of seawater may be achieved. It can be assumed that the base fluid is an oil base having a density of approximately 6.5 PPG. Using an oil base mud system, for example, the mud may be pumped from the surface through the drill string and into the bottom of the well bore at a density of 12.5 PPG, typically at a rate of around 800 gallons per minute. The fluid in the riser, which is at this same density, is then diluted above the sea floor or alternatively below the sea floor with an equal amount or more of base fluid through the riser charging lines. The base fluid is pumped at a faster rate, say 1500 gallons per minute, providing a return fluid with a density that can be calculated as follows:

$$[(F_{Mi}\times Mi)+(F_{Mb}\times Mb)]/(F_{Mi}+F_{Mb})=Mr;$$

where:

$F_{Mi}$=flow rate $F_i$ of fluid, $F_{Mb}$=flow rate $F_b$ of base fluid into riser charging lines, Mi=mud density into well, Mb=mud density into riser charging lines, and Mr=mud density of return flow in riser.

In the above example:

Mi=12.5 PPG,

Mb=6.5 PPG, $F_{Mi}$=800 gpm, and $F_{Mb}$=1500 gpm.

Thus the density Mr of the return mud can be calculated as:

Mr=((800×12.5)+(1500×6.5))/(800+1500)=8.6 PPG. The flow rate, $F_r$, of the mud having the density Mr in the riser is the combined flow rate of the two flows, $F_i$, and $F_b$. In the example, this is:

$$F_r=F_i+F_b=800\text{ gpm}+1500\text{ gpm}=2300\text{ gpm}.$$

The return flow in the riser is a mud having a density of 8.6 PPG (or the same as seawater) flowing at 2300 gpm. This mud is returned to the surface and the cuttings are separated in the usual manner. Centrifuges at the surface will then be employed to separate the heavy mud, density Mi, from the light mud, density Mb.

It is an object and feature of the subject invention to provide a method and apparatus for diluting mud density in deep water and ultra deep water drilling applications for both drilling units and floating platform configurations.

It is another object and feature of the subject invention to provide a method for diluting the density of mud in a riser by injecting low density fluids into the riser lines (typically the charging line or booster line or possibly the choke or kill line) or riser systems with surface BOP's.

It is also an object and feature of the subject invention to provide a method of diluting the density of mud in a concentric riser system.

It is yet another object and feature of the subject invention to provide a method for diluting the density of mud in a riser by injecting low density fluids into the riser charging lines or riser systems with a below-seabed wellhead injection apparatus.

It is a further object and feature of the subject invention to provide an apparatus for separating the low density and high density fluids from one another at the surface.

Other objects and features of the invention will be readily apparent from the accompanying drawing and detailed description of the preferred embodiment.

DESCRIPTION OF A PREFERRED EMBODIMENT OF THE PRESENT INVENTION

Figure 1:
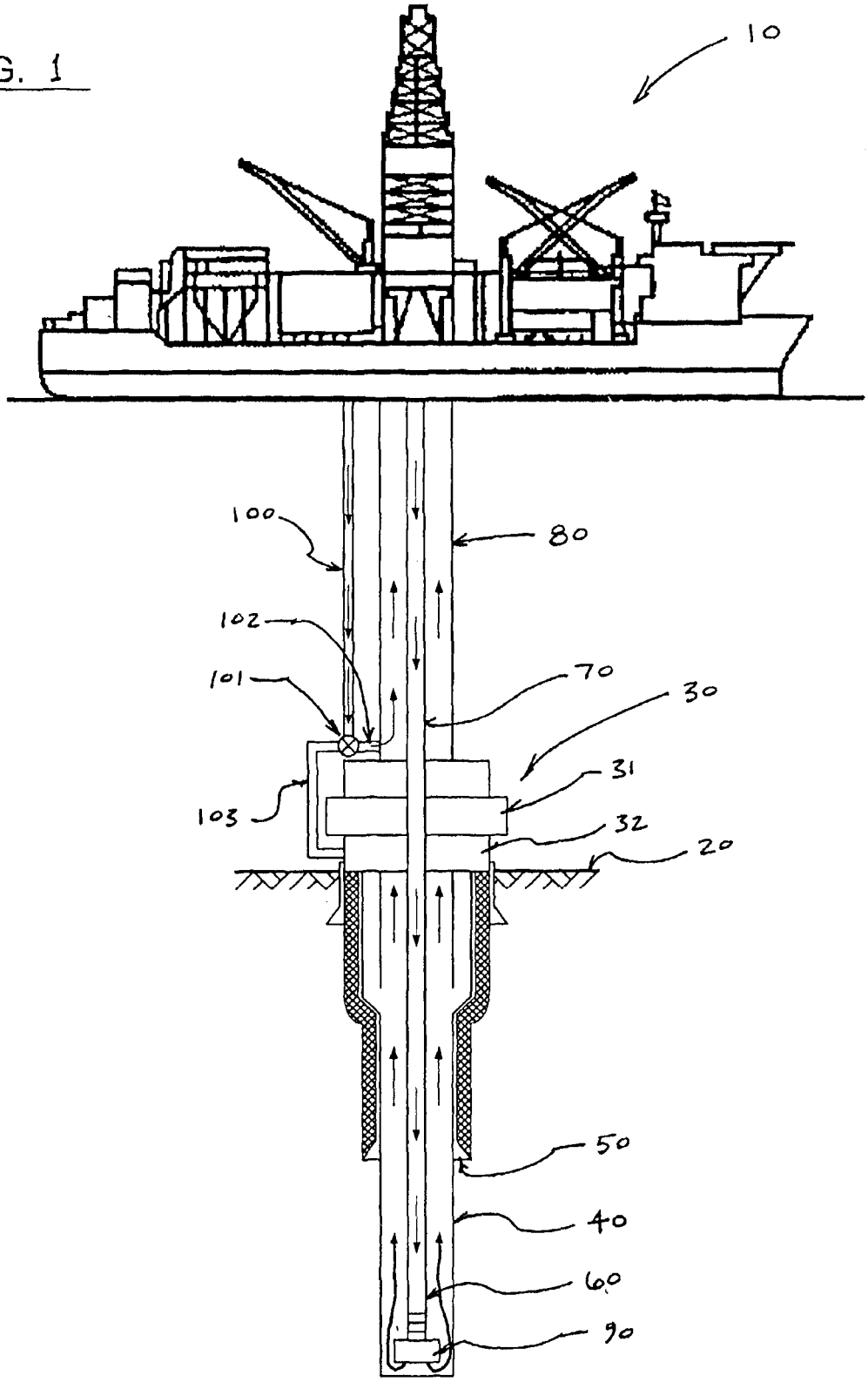
FIG. 1 is a schematic of a typical offshore drilling system modified to accommodate the teachings of the present invention depicting drilling mud being diluted with a base fluid at or above the seabed.

With respect to FIGS. 1–4, a mud recirculation system for use in offshore drilling operations to pump drilling mud: (1) downward through a drill string to operate a drill bit thereby producing drill cuttings, (2) outward into the annular space between the drill string and the formation of the well bore where the mud mixes with the cuttings, and (3) upward from the well bore to the surface via a riser in accordance with the present invention is shown. A platform 10 is provided from which drilling operations are performed. The platform 10 may be an anchored floating platform or a drill ship or a semi-submersible drilling unit. A series of concentric strings runs from the platform 10 to the sea floor or seabed 20 and into a stack 30. The stack 30 is positioned above a well bore 40 and includes a series of control components, generally including one or more blowout preventers or BOP's 31. The concentric strings include casing 50, tubing 60, a drill string 70, and a riser 80. A drill bit 90 is mounted on the end of the drill string 70. A riser charging line (or booster line) 100 runs from the surface to a switch valve 101. The riser charging line 100 includes an above-seabed section 102 running from the switch valve 101 to the riser 80 and a below-seabed section 103 running from the switch valve 101 to a wellhead injection apparatus 32. The above-seabed charging line section 102 is used to insert a base fluid into the riser 80 to mix with the upwardly returning drilling mud at a location at or above the seabed 20. The below-seabed charging line section 103 is used to insert a base fluid into the well bore to mix with the upwardly returning drilling mud via a wellhead injection apparatus 32 at a location below the seabed 20. The switch valve 101 is manipulated by a control unit to direct the flow of the base fluid into either the above-seabed charging line section 102 or the below-seabed charging line section 103.

Figure 5:
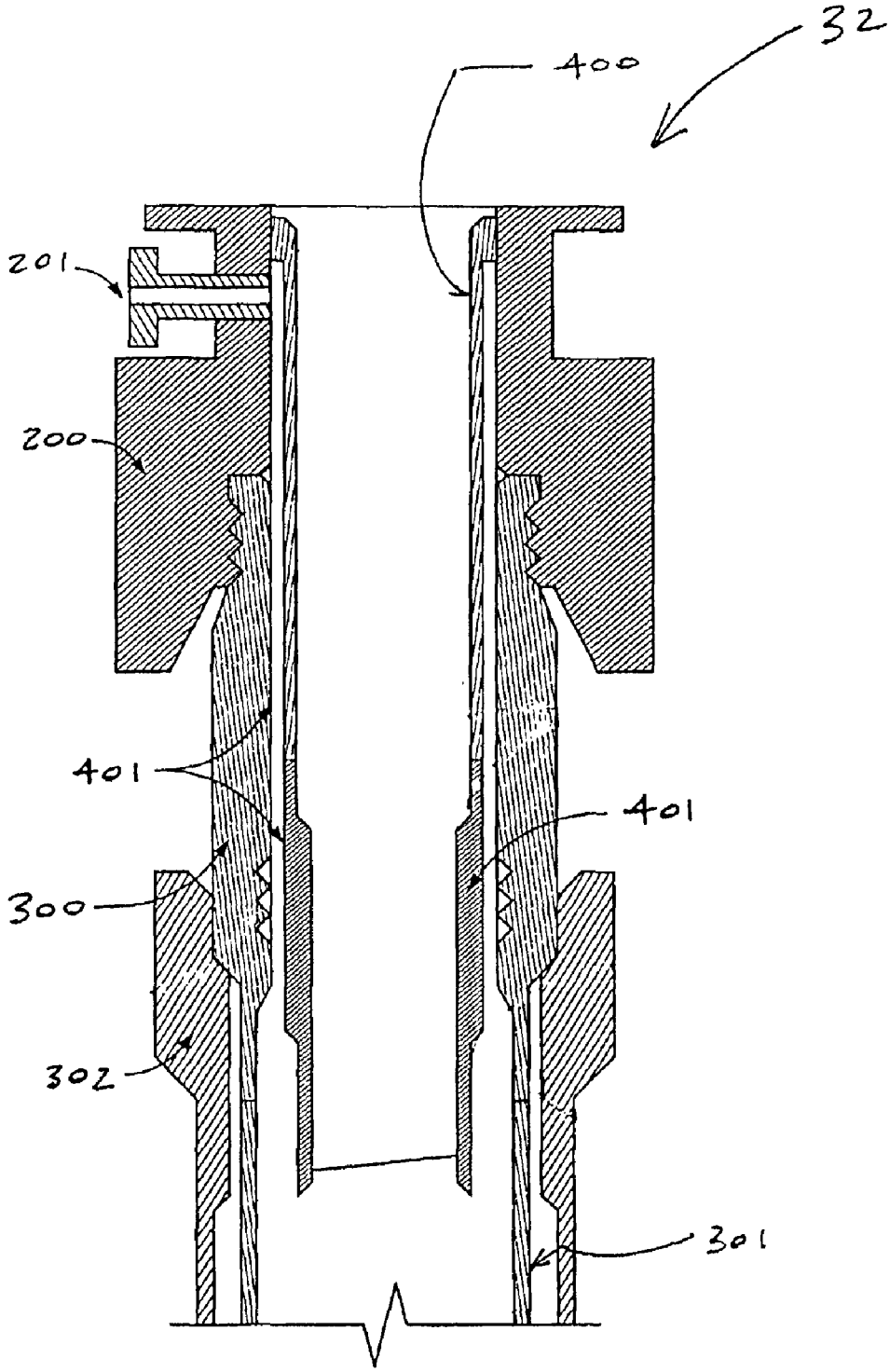
FIG. 5 is an enlarged sectional view of a below-seabed wellhead injection apparatus in accordance with the present invention for injecting a base fluid into drilling mud below the seabed.

With respect to FIG. 5, the wellhead injection apparatus 32 for injecting abase fluid into the drilling mud at a location below the seabed is shown. The injection apparatus 32 includes: (1) a wellhead connector 200 for connection with a wellhead 300 and having an axial bore therethrough and an inlet port 201 for providing communication between the riser charging line 100 (FIG. 3) and the well bore; and (2) an annulus injection sleeve 400 having a diameter less than the diameter of the axial bore of the wellhead connector 200 attached to the wellhead connector thereby creating an annulus injection channel 401 through which the base fluid is pumped downward. The wellhead 300 is supported by a wellhead body 302 which is cemented in place to the seabed.

In a preferred embodiment of the present invention, the wellhead housing 302 is a 36 inch diameter casing and the wellhead 300 is attached to the top of a 20 inch diameter casing. The annulus injection sleeve 400 is attached to the top of a 13⅜ inch to 16 inch diameter casing sleeve having a 2,000 foot length. Thus, in this embodiment of the present invention, the base fluid is injected into the well bore at a location approximately 2,000 feet below the seabed. While the preferred embodiment is described with casings and casing sleeves of a particular diameter and length, it is intended that the size and length of the casings and casing sleeves can vary depending on the particular drilling application.

In operation, with respect to FIGS. 1–5, drilling mud is pumped downward from the platform into the drill string 70 to turn the drill bit 90 via the tubing 60. As the drilling mud flows out of the tubing 60 and past the drill bit 90, it flows into the annulus defined by the outer wall of the tubing 60 and the formation 40 of the well bore. The mud picks up the cuttings or particles loosed by the drill bit 90 and carries them to the surface via the riser 80. A riser charging line 100 is provided for charging (i.e., circulating) the fluid in the riser 80 in the event a pressure differential develops that could impair the safety of the well. The riser mud and cuttings are separated at a typical separator such as the shaker system (FIGS. 2 and 4) and the mud is recycled into the well.

Figure 2:
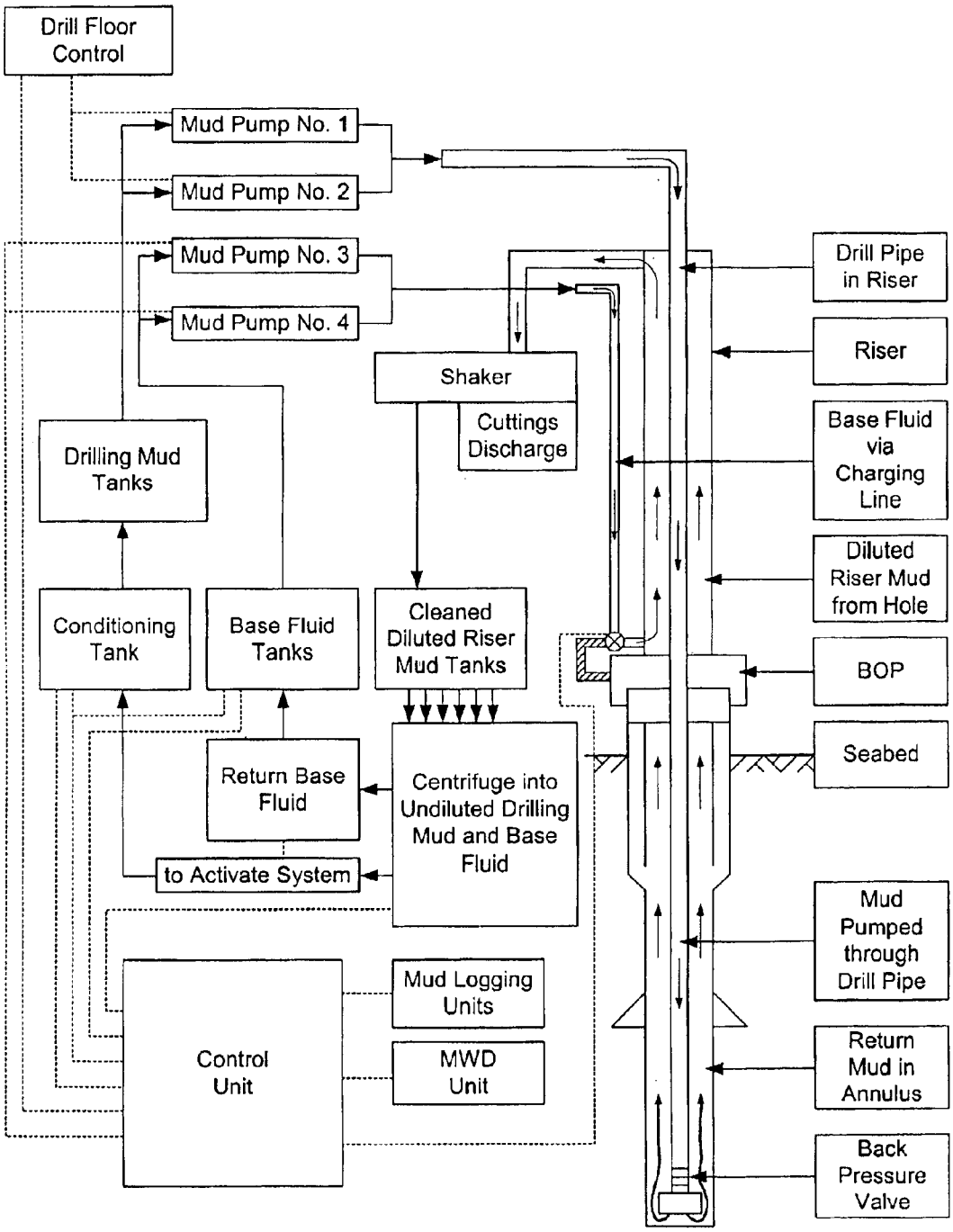
FIG. 2 is a diagram of the drilling mud circulating system in accordance with the present invention for diluting drilling mud at or above the seabed.
Figure 3:
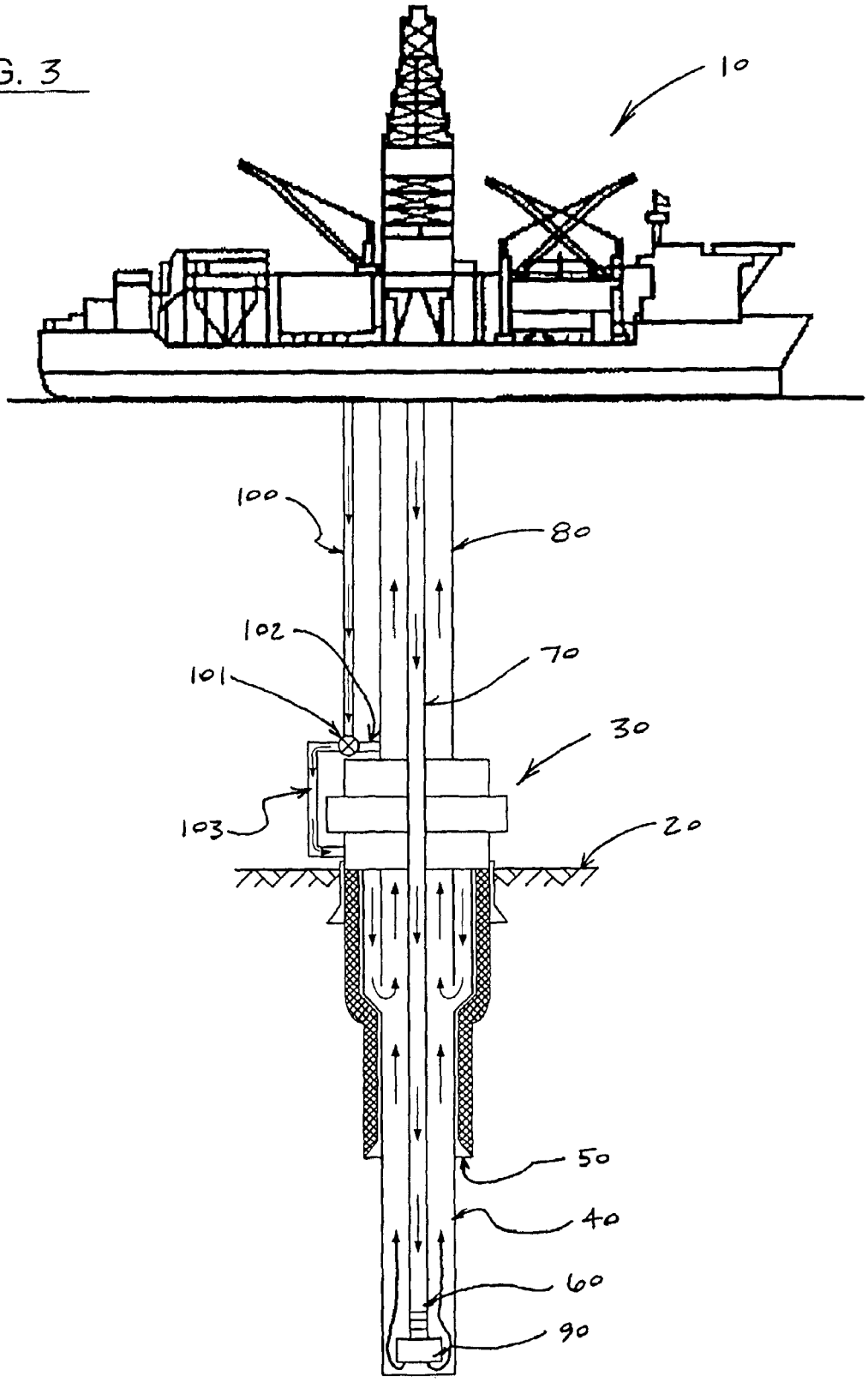
FIG. 3 is a schematic of a typical offshore drilling system modified to accommodate the teachings of the present invention depicting drilling mud being diluted with a base fluid below the seabed.
Figure 4:
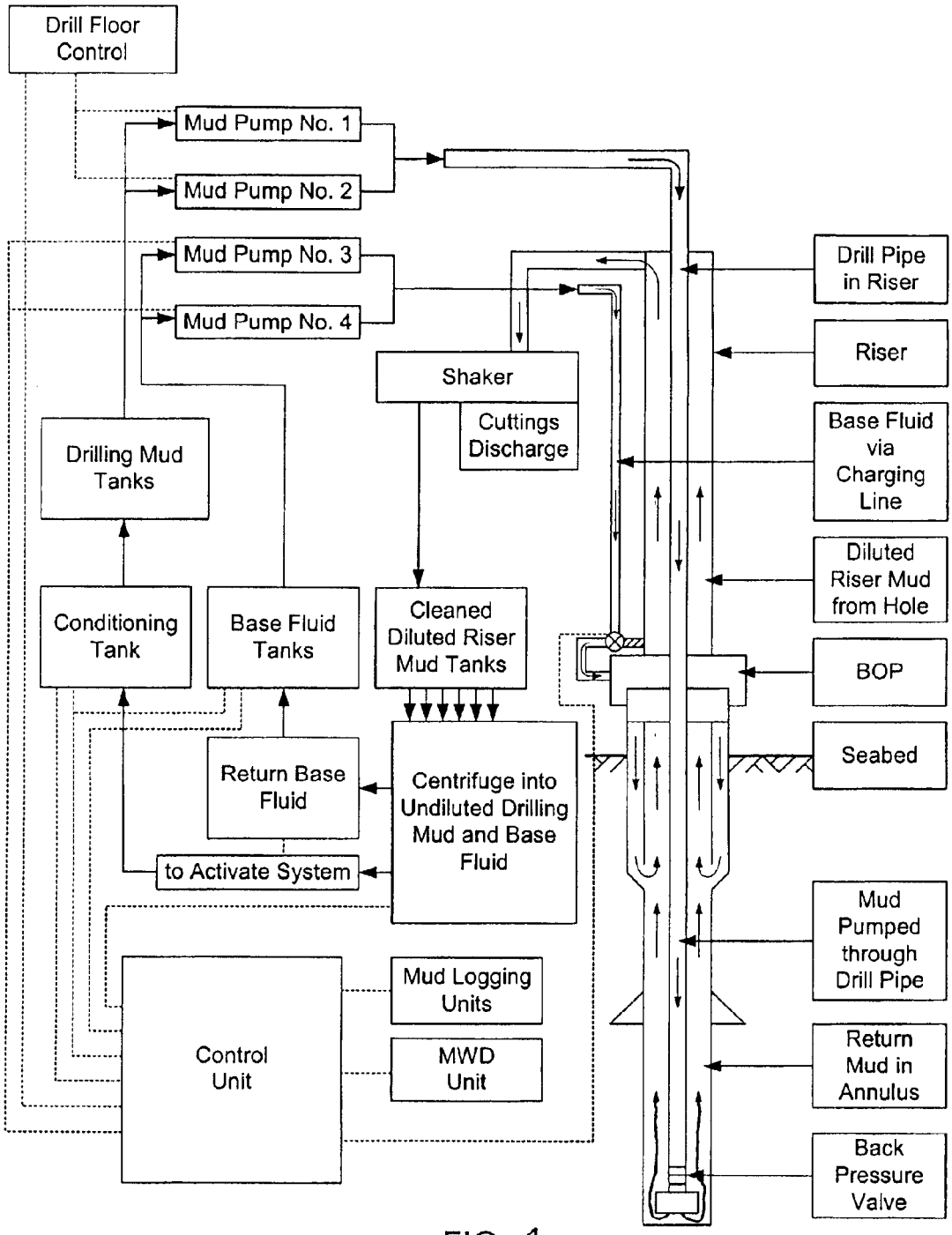
FIG. 4 is a diagram of the drilling mud circulating system in accordance with the present invention for diluting drilling mud below the seabed.

In accordance with a preferred embodiment of the present invention, when it is desired to dilute the rising drilling mud, a base fluid (typically, a light base fluid) is mixed with the drilling mud either at (or immediately above) the seabed or below the seabed. A reservoir contains a base fluid of lower density than the drilling mud and a set of pumps connected to the riser charging line (or booster charging line). This base fluid is of a low enough density that when the proper ratio is mixed with the drilling mud a combined density equal to or close to that of seawater can be achieved. When it is desired to dilute the drilling mud with base fluid at a location at or immediately above the seabed 20, the switch valve 101 is manipulated by a control unit to direct the flow of the base fluid from the platform 10 to the riser 80 via the charging line 100 and above-seabed section 102 (FIGS. 1 and 2). Alternatively, when it is desired to dilute the drilling mud with base fluid at a location below the seabed 20, the switch valve 101 is manipulated by a control unit to direct the flow of the base fluid from the platform 10 to the riser 80 via the charging line 100 and below-seabed section 103 (FIGS. 3 and 4). The combined mud is separated at shaker system to remove the cuttings and is then introduced into a centrifuge system where the lighter base fluid is separated from the heavier drilling fluid. The lighter fluid is then recycled through reservoir base fluid tanks and the riser charging line, and the heavier fluid is recycled in typical manner through the mud management and flow system and the drill string.

In a typical example, the drilling mud is an oil based mud with a density of 12.5 PPG and the mud is pumped at a rate of 800 gallons per minute or "gpm". The base fluid is an oil base fluid with a density of 6.5 to 7.5 PPG and can be pumped into the riser charging lines at a rate of 1500 gpm. Using this example, a riser fluid having a density of 8.6 PPG is achieved as follows:

$$Mr=[(F_{Mi}\times Mi)+(F_{Mb}\times Mb)]/(F_{Mi}+F_{Mb}),$$

where:

$F_{Mi}$=flow rate $F_i$ of fluid, $F_{Mb}$=flow rate $F_b$ of base fluid into riser charging lines, Mi=mud density into well, Mb=mud density into riser charging lines, and Mr=mud density of return flow in riser.

In the above example:

Mi=12.5 PPG,

Mb=6.5 PPG, $F_{Mi}$=800 gpm, and $F_{Mb}$=1500 gpm.

Thus the density Mr of the return mud can be calculated as:

$$Mr=((800\times 12.5)+(1500\times 6.5))/(800+1500)=8.6 \text{ PPG}.$$

The flow rate, $F_r$, of the mud having the density Mr in the riser is the combined flow rate of the two flows, $F_i$, and $F_b$. In the example, this is:

$$F_r=F_i+F_b=800 \text{ gpm}+1500 \text{ gpm}=2300 \text{ gpm}.$$

The return flow in the riser above the base fluid injection point is a mud having a density of 8.6 PPG (or close to that of seawater) flowing at 2300 gpm. This mud is returned to the surface and the cuttings are separated in the usual manner. Conventional separating devices—such as centrifuges—at the surface will then be employed to separate the heavy mud, density Mi, from the light mud, density Mb.

Although the example above employs particular density values, it is intended that any combination of density values may be utilized using the same formula in accordance with the present invention.

Figure 6:
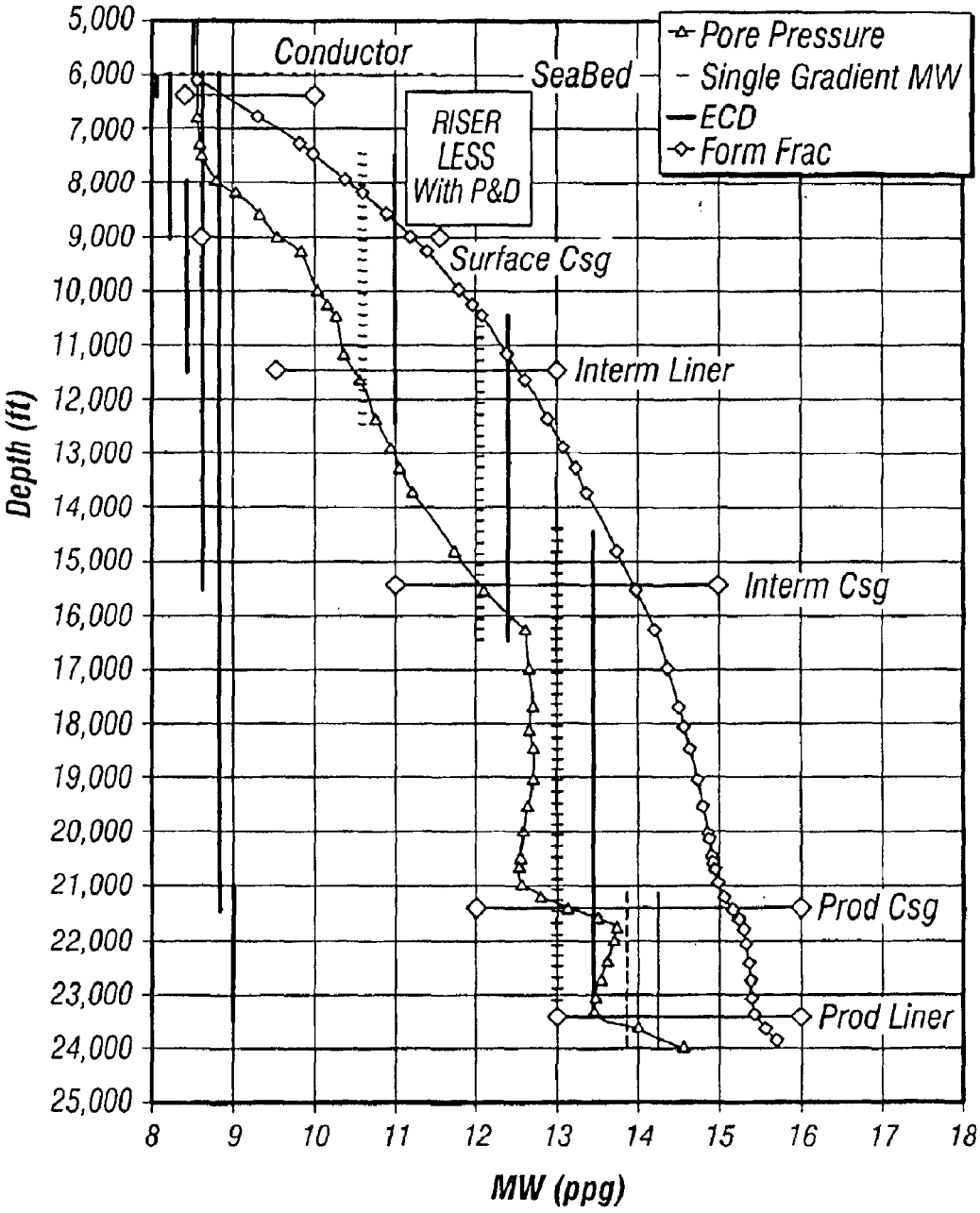
FIG. 6 is a graph showing depth versus down hole pressures in a single gradient drilling mud application.
Figure 7:
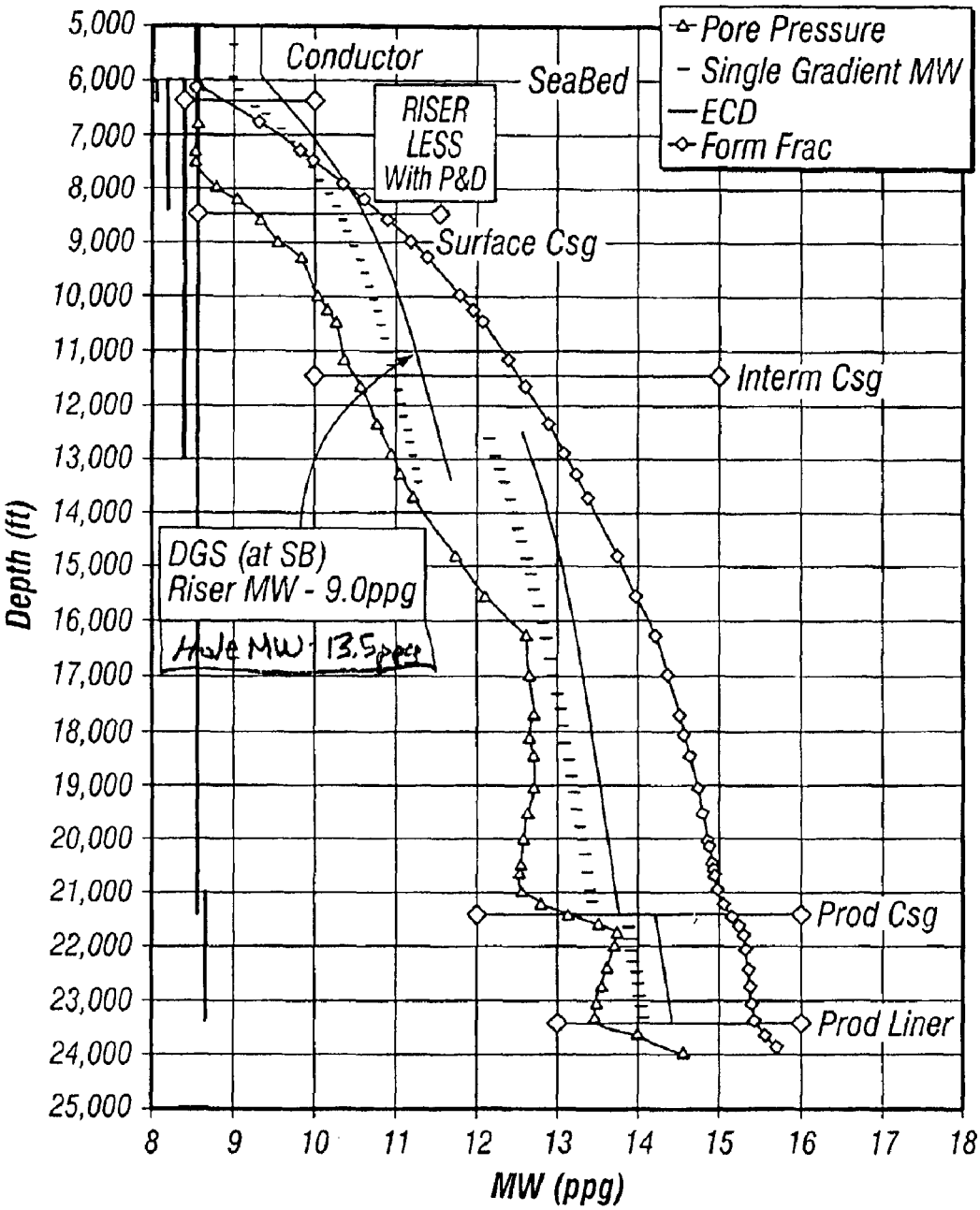
FIG. 7 is a graph showing depth versus down hole pressures and illustrates the advantages obtained using multiple density muds injected at the seabed versus a single gradient mud.
Figure 8:
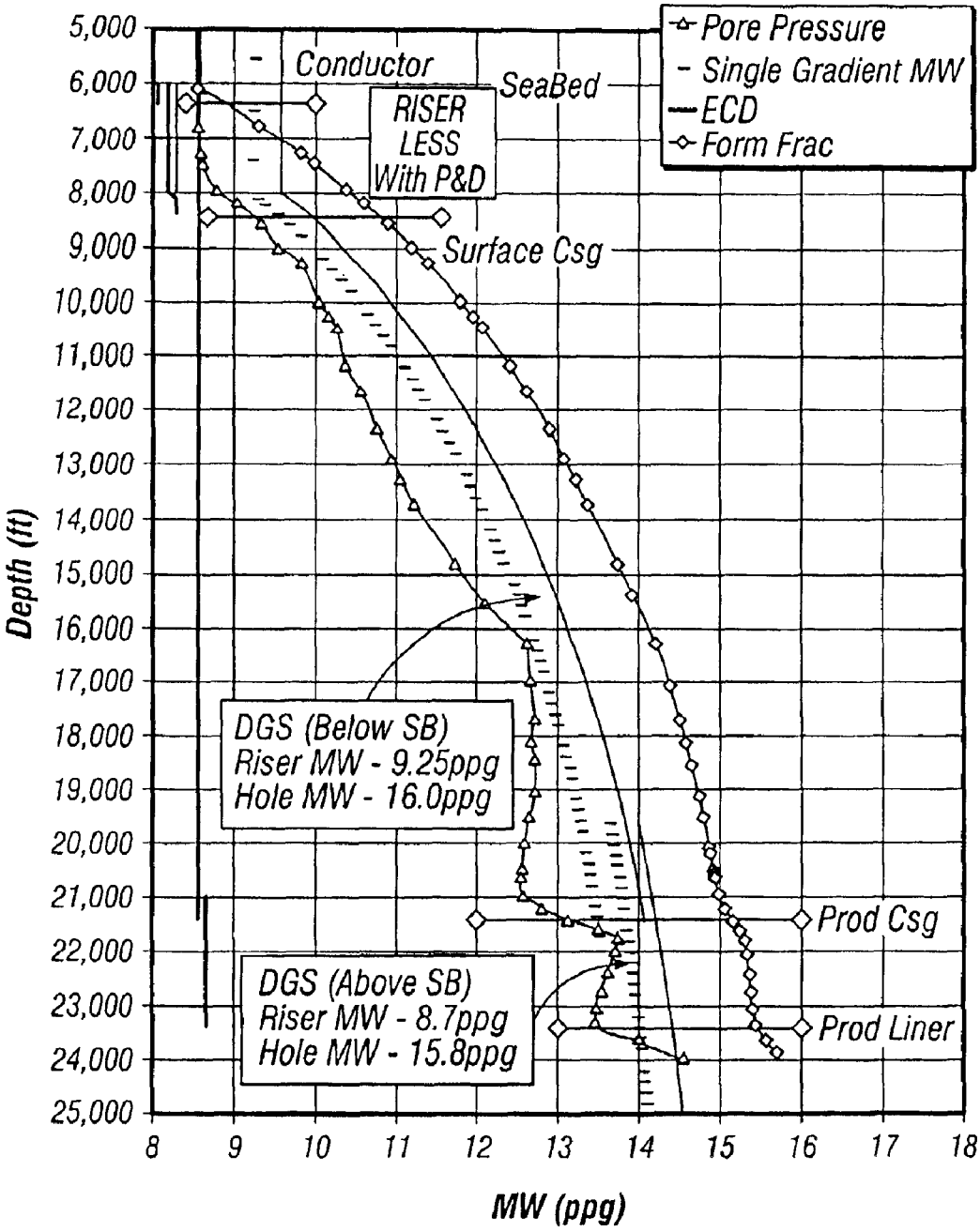
FIG. 8 is a graph showing depth versus down hole pressures and illustrates the advantages obtained using multiple density muds injected below the seabed versus a single gradient mud.

An example of the advantages achieved using the dual density mud method of the present invention is shown in the graphs of FIGS. 6–8. The graph of FIG. 6 depicts casing setting depths with single gradient mud; the graph of FIG. 7 depicts casing setting depths with dual gradient mud inserted at the seabed; and the graph of FIG. 8 depicts casing setting depths with dual gradient mud inserted below the seabed. The graphs of FIGS. 6–8 demonstrate the advantages of using a dual gradient mud over a single gradient mud. The vertical axis of each graph represents depth and shows the seabed or sea floor at approximately 6,000 feet. The horizontal axis represents mud weight in pounds per gallon or "PPG". The solid line represents the "equivalent circulating density" (ECD) in PPG. The diamonds represents formation frac pressure. The triangles represent pore pressure. The bold vertical lines on the far left side of the graph depict the number of casings required to drill the well with the corresponding drilling mud at a well depth of approximately 23,500 feet. With respect to FIG. 6, when using a single gradient mud, a total of six casings are required to reach total depth (conductor, surface casing, intermediate liner, intermediate casing, production casing, and production liner). With respect to FIG. 7, when using a dual gradient mud inserted at or just above the seabed, a total of five casings are required to reach total depth (conductor, surface casing, intermediate casing, production casing, and production liner). With respect to FIG. 8, when using a dual gradient mud inserted approximately 2,000 feet below the seabed, a total of four casings are required to reach total depth (conductor, surface casing, production casing, and production liner). By reducing the number of casings run and installed downhole, it will be appreciated by one of skill in the art that the number of rig days and the total well cost will be decreased.

While certain features and embodiments have been described in detail herein, it should be understood that the invention includes all of the modifications and enhancements within the scope and spirit of the following claims.

In the appended claims: (1) the term "tubular member" is intended to embrace "any tubular good used in well drilling operations" including, but not limited to, "a casing", "a subsea casing", "a surface casing", "a conductor casing", "an intermediate liner", "an intermediate casing", "a production casing", "a production liner", "a casing liner", or "a riser"; (2) the term "drill tube" is intended to embrace "any drilling member used to transport a drilling fluid from the surface to the well bore" including, but not limited to, "a drill pipe", "a string of drill pipes", or "a drill string"; (3) the terms "connected," "connecting", and "connection" are intended to embrace "in direct connection with" or "in connection with via another element"; (4) the term "set" is intended to embrace "one" or "more than one"; and (5) the term "charging line" is intended to embrace any auxiliary riser line, including but not limited to "riser charging line", "booster line", "choke line", or "kill line".

What is claimed is:

1. A method employed at the surface in a well drilling system for varying the density of fluid in a tubular member located below the seabed, said method comprising the steps of:

(a) introducing at the surface a first fluid having a first predetermined density into a drill tube, said first fluid being released from the drill tube and into the tubular member;

(b) introducing a second fluid having a second predetermined density into the tubular member at a location below the seabed for producing a combination fluid having a predetermined density that is defined by a selected ratio of the first fluid and the second fluid, the fluid introduced through an insertion apparatus attached to the top of the tubular member, there being included a charging line running from the surface to the insertion apparatus, wherein the second fluid is released into the charging line and pumped downward through the charging line and into the tubular member via the insertion apparatus, said combination fluid rising to the surface; and (c) separating the combination fluid after it has risen to the surface into the first fluid and the second fluid and storing the first fluid and second fluid in separate storage units at the surface.

2. The method of claim 1, wherein there is a blowout preventer system associated with the drilling system through which the drill tube and tubular member pass, the blowout preventer system being positioned at the seabed and wherein the second fluid is introduced into the tubular member below the blowout preventer system.

3. The method of claim 1, wherein the second density is lower than the first density.

4. The method of claim 3, wherein the second density is lower than the density of seawater and the first density is higher than the density of seawater.

5. The method of claim 3, wherein the second density is less than 8.6 PPG and the first density is greater than 8.6 PPG.

6. The method of claim 3, wherein the second density is 6.5 PPG and the first density is 12.5 PPG.

7. The method of claim 1, wherein the second density is lower than the density of seawater.

8. The method of claim 1, wherein the second density is lower than 8.6 PPG.

9. The method of claim 8, wherein the second density is 6.5 PPG.

10. A method employed at the surface in a well drilling system for varying the density of fluid in a tubular member located below the seabed, the well drilling system of the type having an outer rised and an inner drill tube within the riser, the method comprising the steps of:

(a) introducing at the surface a first fluid having a first predetermined density into a drill tube, said first fluid being released from the drill tube and into the tubular member;

(b) introducing a second fluid having a second predetermined density into the tubular member at a location below the seabed for producing a combination fluid having a predetermined density that is defined by a selected ratio of the first fluid and the second fluid, said combination fluid rising to the surface; and (c) separating the combination fluid after it has risen to the surface into the first fluid and the second fluid and storing the first fluid and second fluid in separate storage units at the surface, wherein the first fluid is introduced into the drill tube at a first flow rate and the second fluid is introduced into the riser at a second flow rate, and wherein the density of the combination fluid is defined by the formula:

$$Mr=[(F_{Mi}\times Mi)+(F_{Mb}\times Mb)]/(F_{Mi}+F_{Mb}),$$

where:

$F_{Mi}$=flow rate $F_i$ of the first fluid, $F_{Mb}$=flow rate $F_b$ of the second fluid, Mi=first density, Mb=second density, and Mr=density of combination fluid.

11. The method of claim 10, wherein the first flow rate is slower than the second flow rate.

12. The method of claim 11, wherein the density of the combination fluid is determined by the combined densities of the first fluid and the second fluid and the first and second flow rates.

13. The method of claim 11, wherein:

Mi=12.5 PPG,

Mb=6.5 PPG, $F_{Mi}$=800 gpm, and $F_{Mb}$=1500 gpm.

14. The method of claim 13, wherein the flow rate $F_r$ of the combination fluid is the combined flow rate $F_i$ of the first fluid and $F_b$ of the second fluid, specifically $F_r=F_i+F_b$.

15. An apparatus for varying the density of upwardly rising drilling fluid in a tubular member having an upper end located at the seabed and a lower end extending below the seabed, said apparatus comprising:

(a) a sleeve having a diameter less than the diameter of the tubular member and having a length less than the length of the tubular member, said sleeve residing within the tubular member to form an annular channel between the tubular member and the sleeve;

(b) a connector for attaching the upper end of the sleeve to the upper end of the tubular member, said connector having an inlet port formed therein for establishing communication between the surface and the annular channel;

(c) a charging line running from the surface to the inlet of the connector, said charging line providing a conduit through which a base fluid having a density different than the density of the rising drilling fluid is released into the tubular member.

16. An apparatus for generating a riser fluid for use in a subsea well containing drilling fluid, said riser fluid having a density different from the drilling fluid, comprising:

(a) a drilling platform;

(b) a wellhead on the seabed;

(c) a drill string connecting the platform to the well, said drill string comprising a drillstem, drill tube, and casing for defining the riser;

(d) a source of drilling fluid having a first predetermined density on the platform for providing the drilling fluid to be introduced into the drill tube;

(e) a source of additional fluid having a second predetermined density on the platform for providing the additional fluid to be inserted into the riser whereby the first fluid and the second fluid are combined in the riser for producing a combined fluid having a density different from the density of the drilling fluid;

(f) a valve for directing the additional fluid, said valve moveable between: (i) a first position where the additional fluid is directed into the riser at a first location which is below the seabed, and (ii) a second position where the additional fluid is directed into the riser at a second location which is above the first location;

(g) a set of charging lines comprising: (i) a first charging line running from the drilling platform to the valve, (ii) a second charging line running from the valve to the riser at the first location, and (iii) a third charging line running from the valve to the riser at the second location; and (h) a separator on the platform for separating the combined fluid into its components as the combined fluid is discharged from the riser.

17. The apparatus of claim 16, wherein the second location is at the seabed.

18. The apparatus of claim 16, wherein the second location is above the seabed.

19. A method of drilling a well below a body of water in which a drill bit is rotated at the end of a drill string, comprising:

(a) injecting into the well at a depth below the water surface a liquid having a lower density than a density of a drilling mud producing a mixture of drilling mud and low-density liquid in the well;

(b) withdrawing the mixture of drilling mud and low-density liquid from an upper end of the well;

(c) separating at least a portion of low-density liquid from the mixture of drilling mud and low-density liquid, thereby producing a drilling mud depleted of low-density liquid;

(d) returning at least a portion of the separated low-density liquid to the depth below the water surface; and (e) returning at least a portion of the drilling mud depleted of low-density liquid to an upper end of the drill string.

20. A method of treating a drilling fluid used in drilling a wellbore in a earth formation below a body of water in which a drill string extends from a water-surface drilling facility into the wellbore and the drilling fluid passes through the drill string and flows from the drill string into the wellbore whereby cuttings resulting from the drilling becomes entrained in the drilling fluid and the drilling fluid with the entrained cuttings returns to the surface of the body of water by means of a return flow system, comprising:

(a) injecting into the return flow system at a depth below the surface of the body of water a liquid having a density lower than a density of the drilling fluid, thereby producing in a return flow system a mixture of drilling fluid and a low-density liquid;

(b) withdrawing the mixture of drilling fluid and low-density liquid from an upper end of the return flow system;

(c) separating at least a portion of the low-density liquid from the mixture of drilling fluid and low-density liquid, thereby producing a drilling fluid depleted of low-density liquid;

(d) returning at least a portion of the separated low-density liquid to the return flow system to the depth below the water surface; and (e) returning at least a portion of the drilling fluid depleted of low-density liquid to the drill string.

* * * * *